US009345914B1

(12) United States Patent
Ali

(10) Patent No.: US 9,345,914 B1
(45) Date of Patent: May 24, 2016

(54) AUTOMATIC FIRE EXTINGUISHING SYSTEM

(71) Applicant: Abdullah Mustafa Yonus Haji Ali, Al Kabeer (KW)

(72) Inventor: Abdullah Mustafa Yonus Haji Ali, Al Kabeer (KW)

( * ) Notice: Subject to any disclaimer, the term of this patent is extended or adjusted under 35 U.S.C. 154(b) by 0 days.

(21) Appl. No.: 14/877,891

(22) Filed: Oct. 7, 2015

(51) Int. Cl.

| | |
|---|---|
| ***A62C 3/00*** | (2006.01) |
| ***A62C 35/02*** | (2006.01) |
| ***A62C 35/11*** | (2006.01) |
| ***A62C 35/13*** | (2006.01) |
| ***A62C 37/36*** | (2006.01) |

(52) U.S. Cl.
CPC .. *A62C 3/00* (2013.01); *A62C 35/02* (2013.01)

(58) Field of Classification Search
CPC ..... A62C 3/00; A62C 3/002; A62C 3/006; A62C 13/76; A62C 13/78; A62C 27/00; A62C 31/28; A62C 35/02; A62C 35/11; A62C 35/13; A62C 37/36; A62C 37/38; A62C 37/40; A62C 99/009
See application file for complete search history.

(56) References Cited

U.S. PATENT DOCUMENTS

| | | | | |
|---|---|---|---|---|
| 3,588,893 | A | 6/1971 | McCloskey | |
| 3,650,281 | A * | 3/1972 | Hurst | B60S 3/04 118/323 |
| 3,665,440 | A | 5/1972 | McMenamin | |
| 4,671,362 | A | 6/1987 | Odashima | |
| 5,860,479 | A * | 1/1999 | LaFollette | A62C 27/00 169/24 |
| RE39,081 | E | 5/2006 | Thomas | |
| 7,619,534 | B2 | 11/2009 | Barrieau et al. | |
| 2007/0210192 | A1 | 9/2007 | Piatti | |
| 2008/0030074 | A1 | 2/2008 | Duong | |
| 2013/0112440 | A1 * | 5/2013 | Alsaif | A62C 27/00 169/46 |
| 2014/0076588 | A1 | 3/2014 | Procious et al. | |
| 2015/0254952 | A1 * | 9/2015 | Chao | G08B 17/10 348/158 |

FOREIGN PATENT DOCUMENTS

| | | | | |
|---|---|---|---|---|
| GB | 2106385 A * | 4/1983 | | A62C 3/00 |
| JP | 2007-007380 | 1/2007 | | |

* cited by examiner

*Primary Examiner* — Darren W Gorman
(74) *Attorney, Agent, or Firm* — Richard C. Litman

(57) ABSTRACT

The automatic fire extinguishing system is installed in one or more rooms of a building structure or the like. A track is installed along the inner perimeter of the wall of the room(s), near the ceiling. A mobile fire extinguishing module travels along the track. The fire extinguishing module includes a supply of fire extinguishing agent, a directionally controllable dispensing nozzle, a drive motor for at least one wheel, and a receiver and controller. A number of smoke and/or fire detectors is installed in the room, with the detectors communicating wirelessly with the receiver and controller of the module. A signal received by the module from an activated detector results in the module traveling to the location nearest the activated detector, whereupon a valve is opened to dispense the fire extinguishing agent. A secondary module may be provided, with the primary module automatically connecting to the secondary module when required.

15 Claims, 8 Drawing Sheets

AUTOMATIC FIRE EXTINGUISHING SYSTEM

BACKGROUND OF THE INVENTION

1. Field of the Invention

The present invention relates generally to fire suppression, and particularly to an automatic fire extinguishing system for installation within a building structure or the like.

2. Description of the Related Art

The chance of fire within a building or other structure, while generally remote, is nonetheless sufficiently serious to warrant the provision of some sort of fire extinguishing device or system within the structure. Such a fire extinguishing device or system is often required in many structures, in accordance with various building codes and standards.

Such fire extinguishing devices and systems may generally be divided into two broad types, i.e., permanently installed systems such as overhead water sprinkler systems, and portable devices such as hand-held fire extinguishers. Such permanently installed systems usually rely upon a fixed network of pipes containing water under pressure (in a "wet pipe") type system), with a series of individual fixed sprinkler heads extending from the pipes. Heat from a fire will melt a fusible link or shatter a glass tube at the sprinkler head(s), thereby allowing water to flow from the pipe system. Portable devices of course rely upon the intervention of a human operator to transport the extinguisher to the site of the fire.

In addition to the devices and systems noted above, a relatively small number of automated portable or mobile extinguishing devices and systems have been developed in the past. An example of such is found in Japanese Patent Publication No. 2007-7380 published on Jan. 18, 2007 to Ind. Tech, Res. Inst. This reference describes (according to the drawings, English abstract, and machine generated translation) a mobile fire extinguishing module that travels along the sides of a vehicle tunnel. There is a plurality of sensors installed in the tunnel, with the sensors being monitored in turn from a remote location. A water supply line extends the length of the tunnel, with the fire extinguishing module drawing water from the supply line at whichever point the module may be located.

Thus, an automatic fire extinguishing system solving the aforementioned problems is desired.

SUMMARY OF THE INVENTION

The automatic fire extinguishing system can include a fire extinguishing module and a track upon which the fire extinguishing module may travel. The track is installed about the inner perimeter of the wall of a room or other internal division of a building structure, near the ceiling of the room. Upper and lower rails of the track extend about the upper portion of the wall. The fire extinguishing module may travel by means of a series of rollers or wheels on the module, with the wheels engaging the rails. The module includes a pressurized container of fire extinguishing agent, e.g., water, etc., which is dispersed or sprayed from a directionally controllable nozzle on the module. The module further contains a drive motor driving at least one of the rollers or wheels, and a receiver and controller that communicates wirelessly with a series of smoke and/or flame sensors or detectors in the room.

When smoke or a fire is detected by one of the sensors, the activated sensor sends a signal to the receiver and controller in the fire extinguishing module. The receiver and controller determines the location of the activated sensor, and signals the drive motor to propel the module to a location along the track that is nearest to the activated sensor. The directionally controllable nozzle includes an infrared detector, with the detector sensing the specific direction of the heat source. The nozzle is gimbaled and driven about its horizontal and vertical axes by corresponding motors or servos, to aim the nozzle at the heat source detected by the infrared detector.

Another embodiment includes a secondary extinguisher module that can be connected automatically to the first module. The secondary module has no propulsion or fire detection means, but includes a second container of fire extinguishing agent therein. The primary module may be driven along the track until connecting to the secondary module, with the container of fire extinguishing agent in the second module automatically connecting to the container of fire extinguishing agent in the first module. The primary module then pushes or pulls the secondary module to the location of the fire, with both containers of fire extinguishing agent being available to extinguish the fire.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
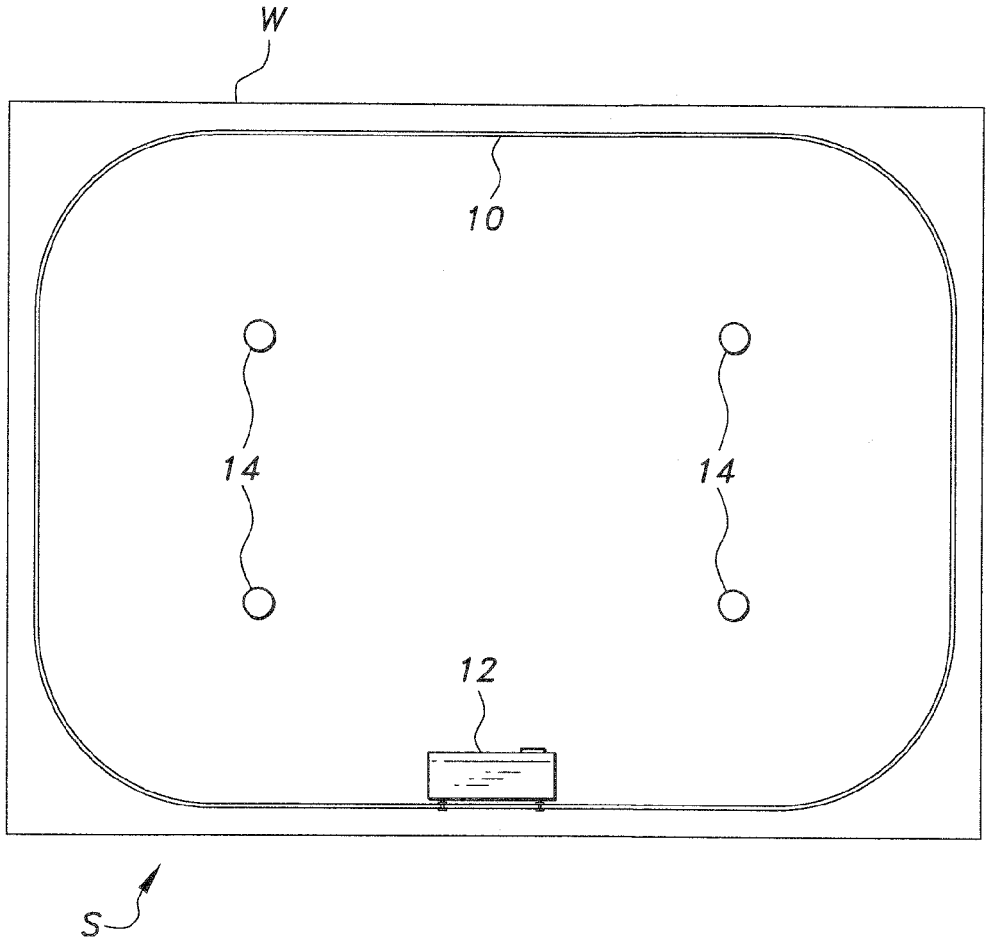
FIG. 1 is a schematic top plan view of an automatic fire extinguishing system according to the present invention, illustrating an exemplary configuration.

The automatic fire extinguishing system includes an automated mobile fire extinguishing module and an endless track for installation within a building structure or the like. FIG. 1 provides a schematic top plan view of an exemplary installation in a building structure S. The endless track 10 is installed about the inner perimeter of the wall W of the structure S, preferably along the upper portion of the wall W adjacent the ceiling of the structure S. The mobile fire extinguishing module 12 is installed upon the track 10. One or more smoke and/or fire detectors 14 are installed within the structure S. The smoke and/or fire detectors 14 are conventional, and include low powered transmitters for sending a signal(s) to the module 12 in the event that smoke or fire is detected by one of the detectors 14. The module 12 then travels along the track 10 to the location of the smoke or fire, in response to the signal received from the detector(s) 14.

Figure 2:
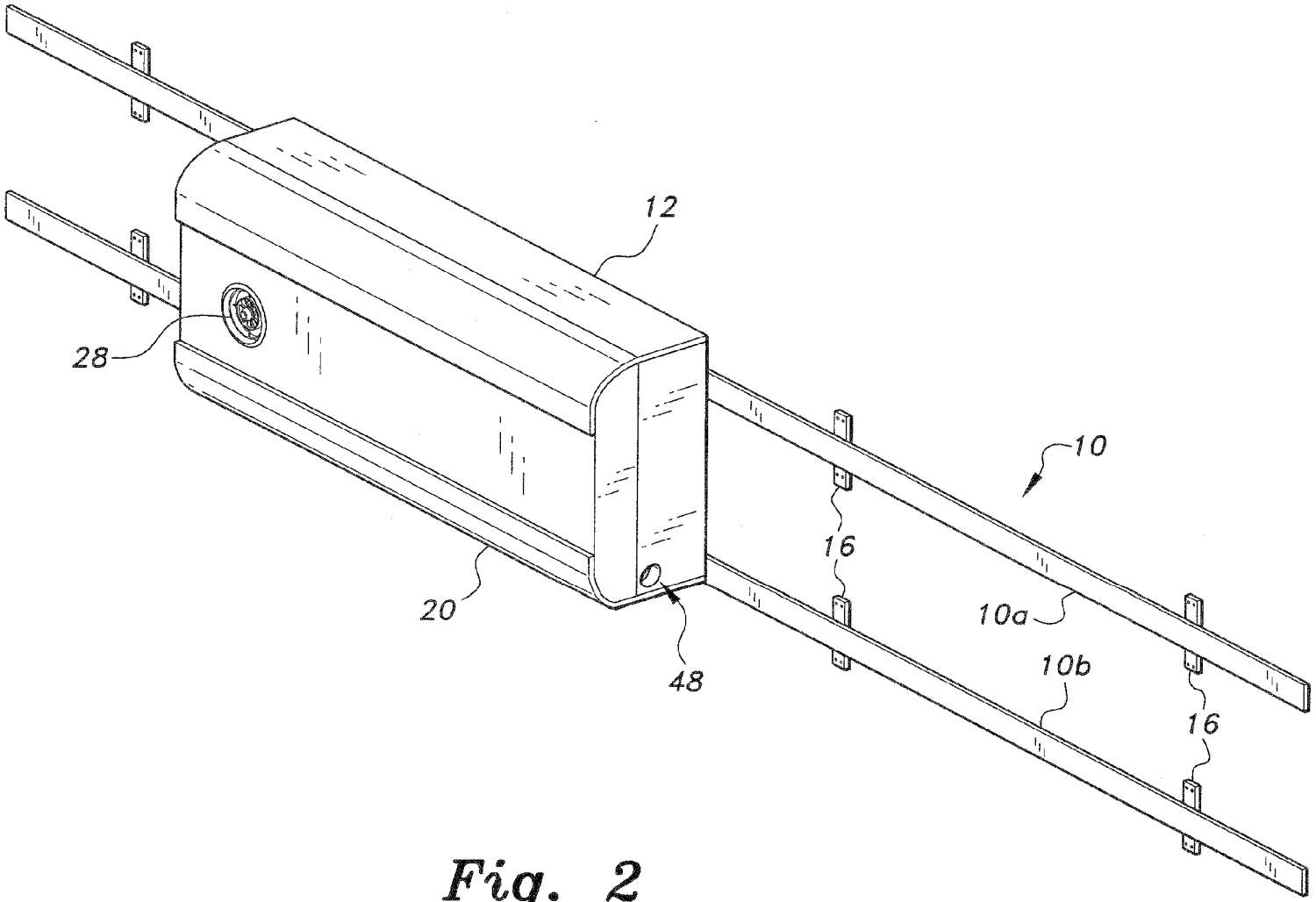
FIG. 2 is a front perspective view of the first fire extinguishing module of the automatic fire extinguishing system according to the present invention, the track being broken away for clarity in the drawing Fig.
Figure 3:
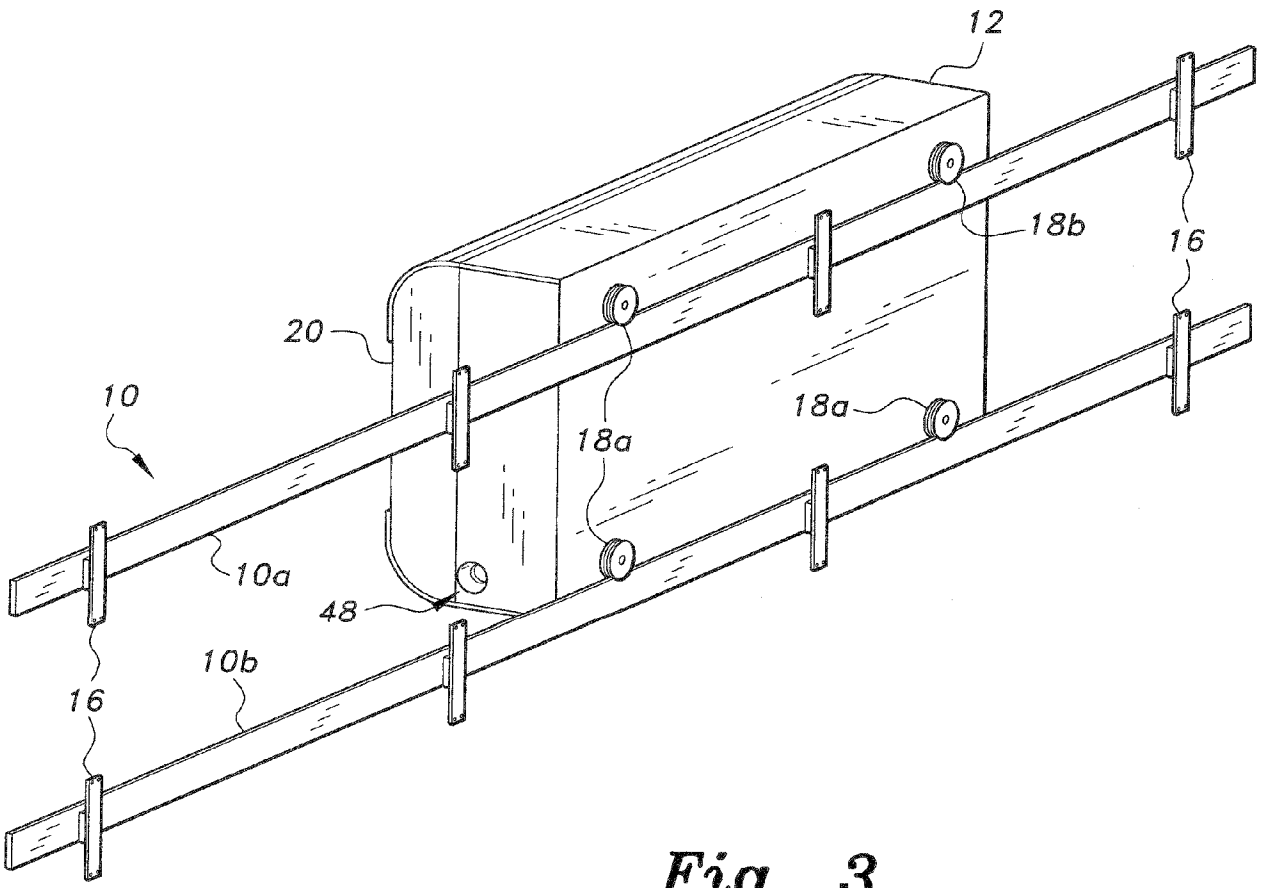
FIG. 3 is a rear perspective view of the first fire extinguishing module of the automatic fire extinguishing system according to the present invention showing the roller or wheel engagement with the track, the track being broken away for clarity in the drawing Fig.

FIGS. 2 and 3 respectively provide front and rear perspective views of the module 12 installed along a section of the track 10. It will be seen that the track 10 comprises two vertically separated rails, i.e., an upper rail 10*a* and a lower rail 10*b*, attached to the wall (not shown in FIGS. 2 and 3) by a series of standoffs 16. The module 12 includes a series of passive wheels or rollers 18*a* that ride along the two rails 10*a* and 10*b* of the track 10, and a single drive wheel 18*b*, as shown in FIG. 3.

Figure 4:
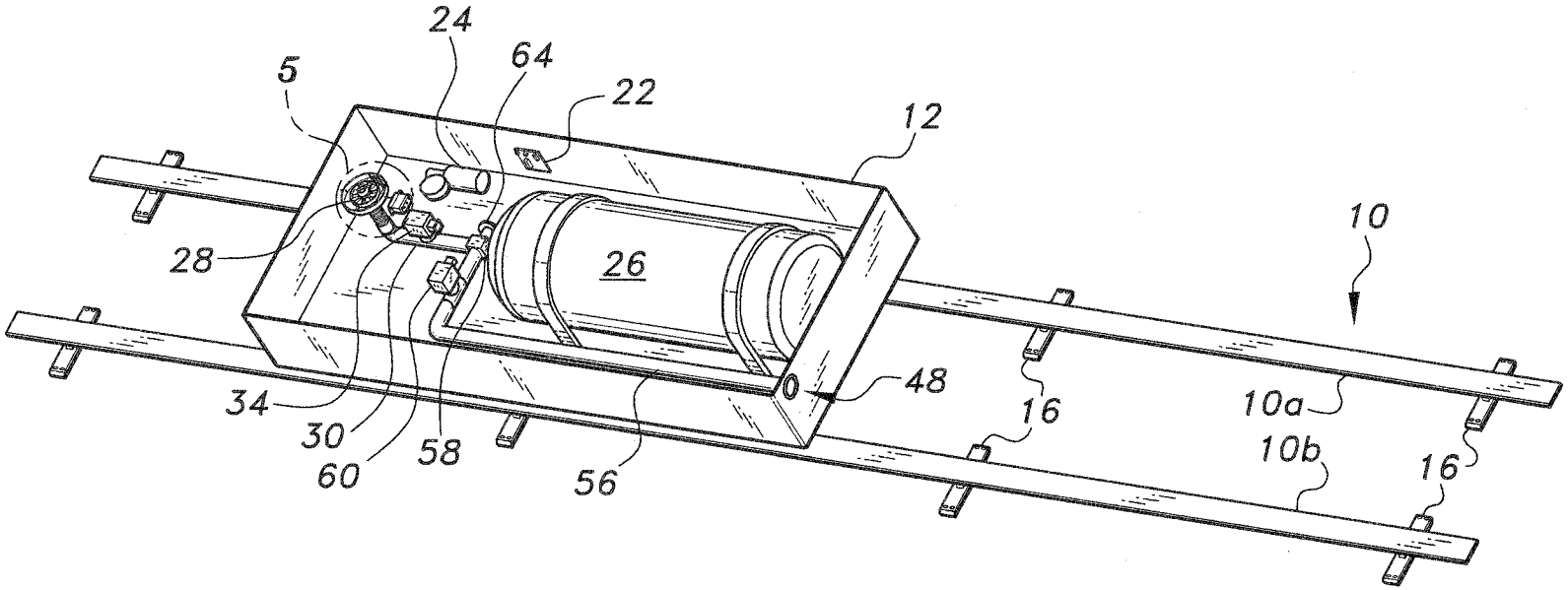
FIG. 4 is a front perspective view of the first fire extinguishing module of the automatic fire extinguishing system according to the present invention with the cover removed to show the internal components, the track being broken away for clarity in the drawing Fig.

FIG. 4 provides a front perspective view of the module 12 with its cover 20 removed to show the internal components of the module 12. The outer housing or shell of the module 12 and its cover 20 are preferably formed of a fire resistant and thermally insulating material in order to protect the internal components of the module 12. The module 12 includes a combination detector receiver and module controller 22 therein, for detecting signals received from one or more of the smoke and/or fire detectors 14 shown in FIG. 1 and for controlling the operation of the system for driving the drive wheel 18 for moving the module 12 to the desired location. The receiver and controller 22 communicates with a propulsion system 24 comprising an electric motor and gear reduction drive, with the drive wheel 18*b* (FIG. 3) disposed upon the axle of the gear reduction drive. A conventional electrical storage battery and wiring (not shown) are used to provide electrical power for the receiver and controller 22 and the propulsion system 24, and other electrically powered components of the module 12 as described further below. The module 12 contains a container 26 of water or other fire extinguishing agent therein.

Figure 5:
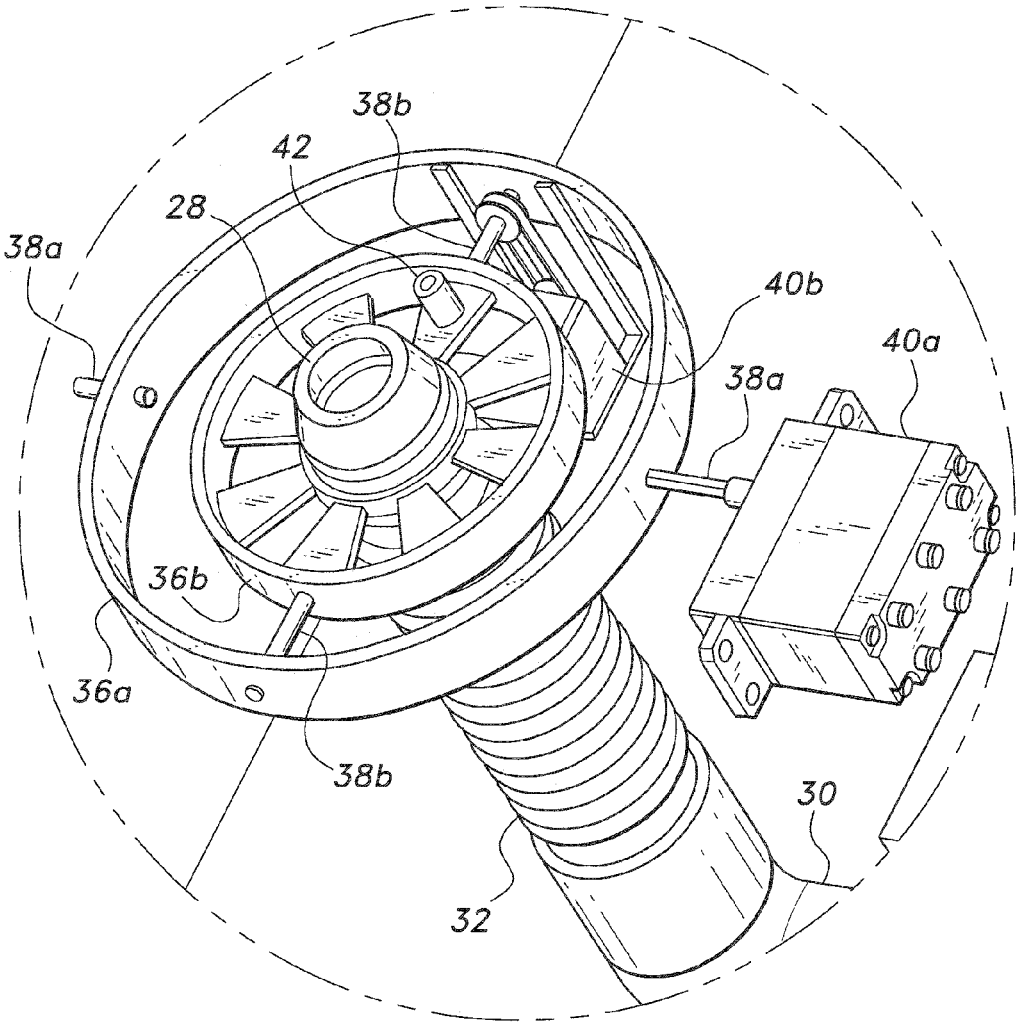
FIG. 5 is a detailed perspective view of the agent dispensing nozzle of the automatic fire extinguishing system according to the present invention, illustrating various details thereof.

The module 12 includes a selectively articulating fire extinguishing agent dispensing nozzle 28, with details of the nozzle 28 being shown in the detailed perspective view of FIG. 5. The nozzle 28 is connected to the fire extinguishing agent container 26 (FIG. 4) by a primary dispenser pipe or tube 30 and a flexible line or tube 32. Flow of extinguishing agent from the container 26 to the nozzle 28 is controlled by an electronically controlled primary valve 34 (FIG. 4). The nozzle 28 is suspended concentrically within a pair of gimbal rings comprising a first or outer ring 36*a* and a second or inner ring 36*b* concentrically disposed within the first ring 36*a*. The first or outer gimbal ring 36*a* rotates or pivots about a first or horizontal axis 38*a*, and is driven by a first gimbal drive motor 40*a*. The second or inner gimbal ring 36*b* is disposed between the first gimbal ring 36*a* and the nozzle 28 and rotates about a second or vertical axis 38*b* that extends across the first or outer gimbal ring 36*a* and orthogonal to the first axis 38*a*, and is driven by a second gimbal drive motor 40*b*. This mechanism properly aims the nozzle 28 in the general location of a fire. An infrared sensor 42 is disposed with the nozzle 28, and is aligned substantially with the axis of the nozzle 28.

When smoke or fire is detected by one of the detectors 14 (FIG. 1) by the receiver and controller 22 of the module 12 (FIG. 4), the receiver and controller 22 directs the propulsion system 24 (FIG. 4) to drive the module 12 along the track 10 to a position as close as possible to the smoke or fire. The receiver and controller 22 then directs the gimbal drive motors 40*a* and 40*b* to swivel the gimbals 36*a* and 36*b*, and thereby the infrared sensor 42 and nozzle 28, until the infrared sensor 28 detects the maximum heat emitted by the source. The receiver and controller 22 then directs the gimbal drive motors 40*a*, 40*b* to stop their operation and further directs the primary control valve 34 to open, thereby allowing fire extinguishing agent to flow from the pressurized container 26 to be dispensed from the nozzle 28. The receiver and controller 22 may periodically direct the gimbal drive motors 40*a* and 40*b* to oscillate the respective gimbals 36*a*, 36*b* in order to adjust the aim of the infrared sensor 42 to detect other heat sources during the operation after the primary heat source has been extinguished or substantially reduced, and direct the nozzle 28 to dispense fire extinguishing agent toward those other heat sources.

Figure 6:
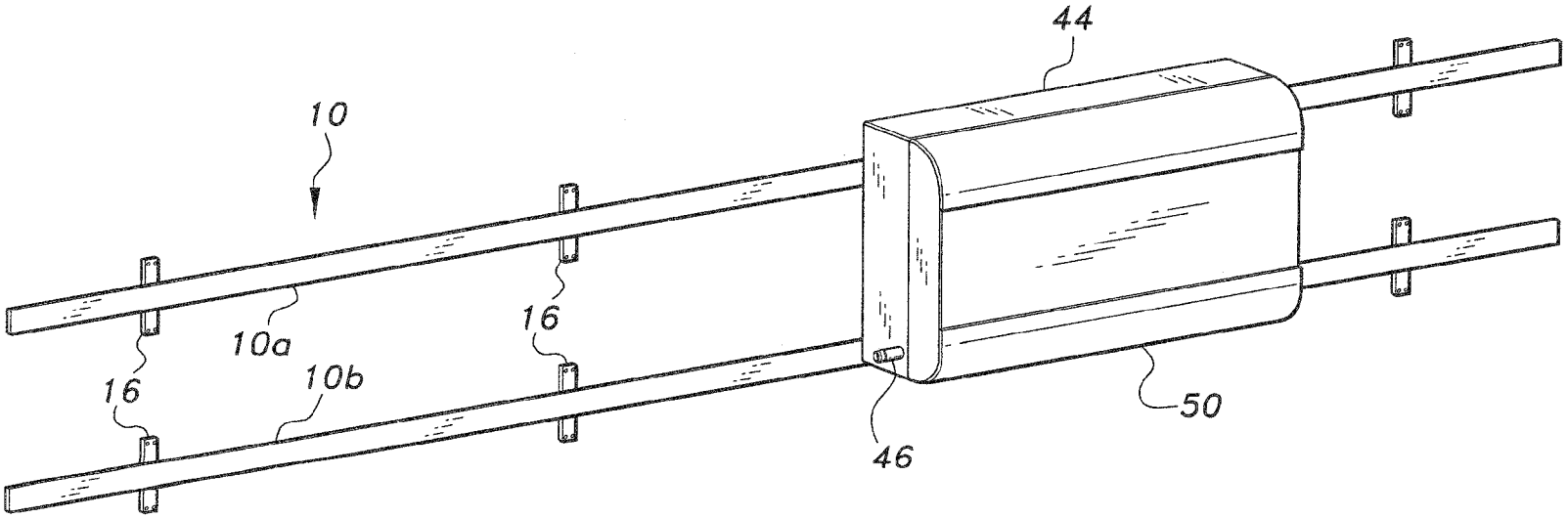
FIG. 6 is a front perspective view of the second fire extinguishing module of the automatic fire extinguishing system according to the present invention, the track being broken away for clarity in the drawing Fig.
Figure 7:
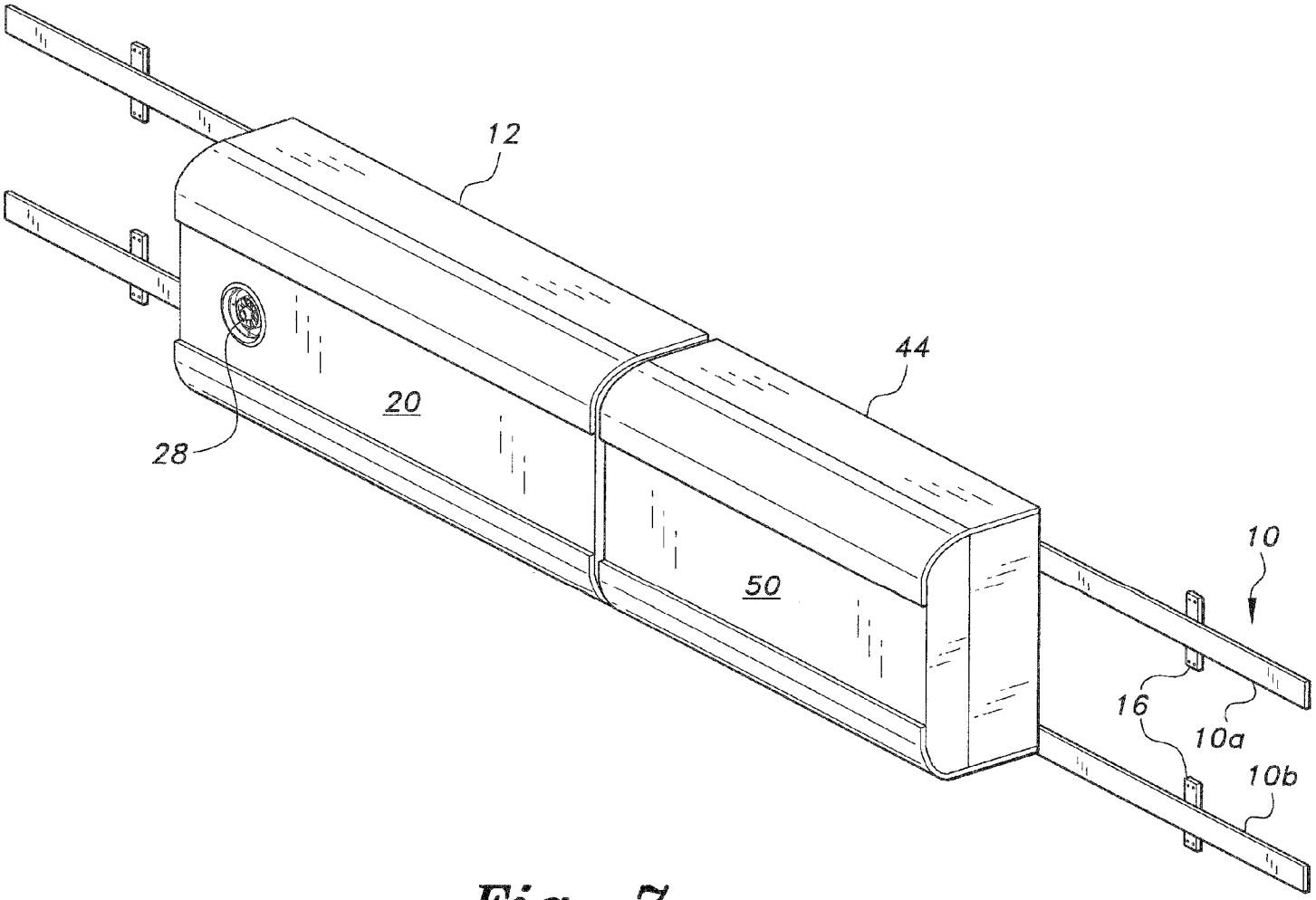
FIG. 7 is a front perspective view of the joined first and second fire extinguishing modules of the automatic fire extinguishing system according to the present invention, the track being broken away for clarity in the drawing Fig.
Figure 8:
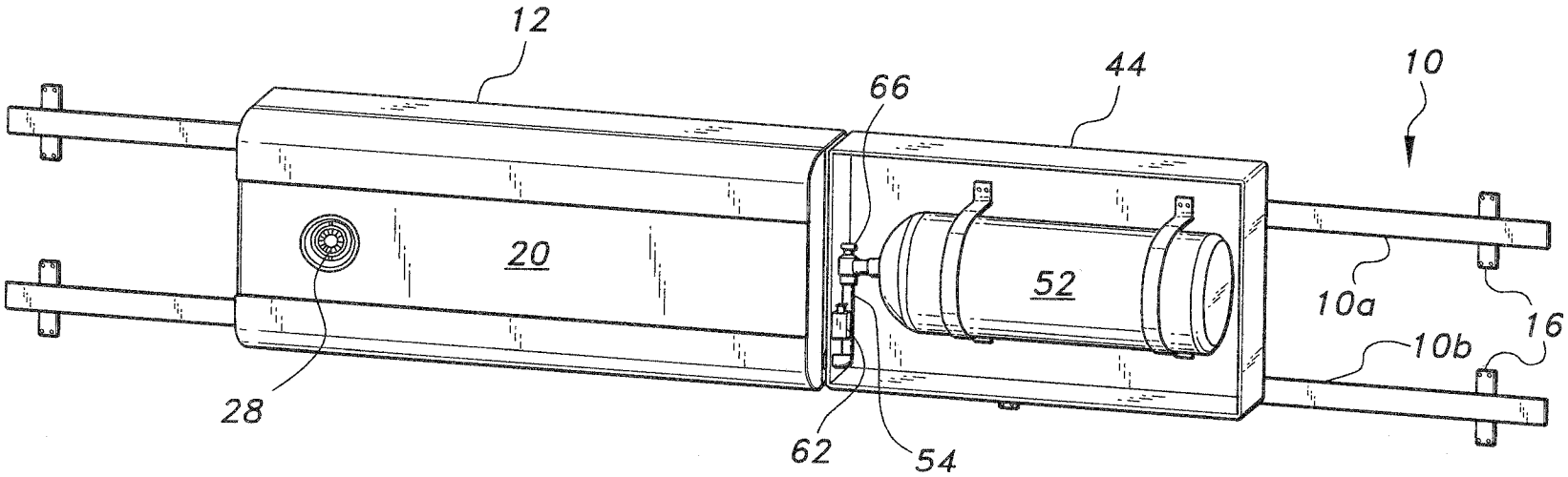
FIG. 8 is a front perspective view of the joined first and second fire extinguishing modules of the automatic fire extinguishing system according to the present invention with the cover of the second module removed to illustrate the internal components thereof, the track being broken away for clarity in the drawing Fig.

FIGS. 6 through 8 provide perspective views of a secondary fire extinguisher module 44 that can be connected to the primary fire extinguisher module 12 described further above. The secondary module 44 travels along the track 10 in the manner of the primary module 12, i.e., having a series of passive wheels or rollers as in the wheels or rollers 18*a* of the primary module 12 shown in FIG. 3. However, the secondary module 44 does not include a drive or propulsion roller or wheel, as the module 44 does not have a propulsion system onboard. Rather, the secondary module 44 includes a tubular protrusion 46 extending from one end thereof, with the tubular protrusion 46 comprising a primary module connector. The primary module 12 includes a receptacle 48 (FIGS. 2 through 4) that comprises a secondary module connector. The two connectors 46 and 48 may comprise conventional quick disconnect fittings, as are known and used for various pneumatic and hydraulic connections. The two connectors 46 and 48 can be connected to one another, with the primary module 12 pushing or pulling the secondary module 44 therewith when the two modules are connected together by their connectors 46 and 48, by means of the propulsion system 24 of the primary module 12.

FIG. 8 provides a perspective view of the two modules 12 and 44 connected to one another, with the cover 50 of the secondary module 44 removed. The secondary module 44 contains a secondary container 52 of fire extinguishing agent that communicates with the tubular protrusion of the primary module connector via a connecting tube or pipe 54. Returning to FIG. 4, it will be seen that a secondary module supply or delivery pipe or tube 56 extends through the primary module 12 from the secondary module connector receptacle 48 to a tee 58 in the primary dispenser pipe or tube 30. An electronically controlled valve 60 is provided in the secondary module supply pipe or tube 56 of the primary module 12, with this valve 60 being actuated by the receiver and controller 22 of the primary module 12 when the secondary module 44 is connected thereto. An additional electronically controlled valve 62 of the secondary module 44 and manually controlled valves 64 of the primary module 12 and 66 of the secondary module 44 may be provided for additional control of the fire extinguishing agent.

In the event that a conflagration of sufficient heat or intensity is detected by the smoke and/or fire detectors 14 of FIG. 1, the combination receiver and controller 22 (FIG. 4) of the primary module 12 may direct the primary module 12 to travel along the track 10 to connect to the secondary module 44 by means of their connectors 46 and 48 described above. When the two modules 12 and 44 have been connected, the primary module 12 travels along the track 10 to a location nearest the fire, and operates the articulating nozzle 28 as described above to at least reduce, if not extinguish the fire. When the fire extinguishing agent container 26 of the primary module 12 has been exhausted, or nearly so, the receiver and controller 22 directs the electronically controlled valves 60 of the secondary module 44 to open, thereby continuing to supply fire extinguishing agent from the container 52 of the secondary module 44 to extinguish the fire.

It is to be understood that the present invention is not limited to the embodiments described above, but encompasses any and all embodiments within the scope of the following claims.

I claim:

1. An automatic fire extinguishing system for a building structure, the system comprising:

an endless track disposed within the building structure;

a primary mobile fire extinguishing module disposed upon the track;

a detector receiver and module controller disposed in the module;

a plurality of smoke and fire detectors disposed within the building structure, at least one of the smoke and fire detectors communicating with the detector receiver of the module when the at least one of the detectors is actuated;

a selectively movable agent dispensing nozzle disposed upon the module;

an infrared sensor disposed with the nozzle;

a first gimbal ring disposed about the nozzle, the first gimbal ring having a first axis;

a first gimbal drive motor communicating with the first gimbal ring;

a second gimbal ring disposed between the nozzle and the first gimbal ring, the second gimbal ring having a second axis orthogonally disposed relative to the first axis; and a second gimbal drive motor communicating with the second gimbal ring, the infrared sensor directing the first and second gimbal drive motors for aiming the nozzle.

2. The automatic fire extinguishing system according to claim 1, further comprising:

a container of fire extinguishing agent disposed within the module; and a propulsion system disposed within the module.

3. The automatic fire extinguishing system according to claim 1, further comprising:

a secondary mobile fire extinguishing module disposed upon the track;

a secondary module connector disposed upon the primary module; and a primary module connector disposed upon the secondary module.

4. The automatic fire extinguishing system according to claim 3, wherein:

the secondary module connector of the primary module comprises a receptacle; and the primary module connector of the secondary module comprises a tubular protrusion.

5. The automatic fire extinguishing system according to claim 1, wherein the track comprises a first rail and a second rail, the first and second rails being vertically separated from one another.

6. An automatic fire extinguishing system for a building structure, the system comprising:

an endless track disposed within the building structure;

a primary mobile fire extinguishing module disposed upon the track;

a container of fire extinguishing agent disposed within the primary mobile fire extinguishing module;

a propulsion system disposed within the primary mobile fire extinguishing module;

a selectively movable agent dispensing nozzle disposed upon the primary mobile fire extinguishing module;

an infrared sensor disposed with the nozzle;

a first gimbal ring disposed about the nozzle, the first gimbal ring having a first axis;

a first gimbal drive motor communicating with the first gimbal ring;

a second gimbal ring disposed between the nozzle and the first gimbal ring, the second gimbal ring having a second axis orthogonally disposed relative to the first axis; and a second gimbal drive motor communicating with the second gimbal ring, the infrared sensor directing the first and second gimbal drive motors for aiming the nozzle.

7. The automatic fire extinguishing system according to claim 6, further comprising:

a detector receiver and module controller disposed in the module; and a plurality of smoke and fire detectors disposed within the building structure, at least one of the smoke and fire detectors communicating with the detector receiver of the module when the at least one of the detectors is actuated.

8. The automatic fire extinguishing system according to claim 6, further comprising:

a secondary mobile fire extinguishing module disposed upon the track;

a secondary module connector disposed upon the primary module; and a primary module connector disposed upon the secondary module.

9. The automatic fire extinguishing system according to claim 8, wherein:

the secondary module connector of the primary module comprises a receptacle; and the primary module connector of the secondary module comprises a tubular protrusion.

10. The automatic fire extinguishing system according to claim 6, wherein the track comprises a first rail and a second rail, the first and second rails being vertically separated from one another.

11. An automatic fire extinguishing system for a building structure, the system comprising:

an endless track disposed within the building structure;

a primary mobile fire extinguishing module disposed upon the track;

a secondary mobile fire extinguishing module disposed upon the track;

a secondary module connector disposed upon the primary module;

a primary module connector disposed upon the secondary module;

a selectively articulating agent dispensing nozzle disposed upon the primary module;

an infrared sensor disposed with the nozzle;

a first gimbal ring disposed about the nozzle, the first gimbal ring having a first axis;

a first gimbal drive motor communicating with the first gimbal ring;

a second gimbal ring disposed between the nozzle and the first gimbal ring, the second gimbal ring having a second axis orthogonally disposed relative to the first axis; and a second gimbal drive motor communicating with the second gimbal ring, the infrared sensor directing the first and second gimbal drive motors for aiming the nozzle.

12. The automatic fire extinguishing system according to claim 11, further comprising:

a detector receiver and module controller disposed in the primary module; and a plurality of smoke and fire detectors disposed within the building structure, at least one of the smoke and fire detectors communicating with the detector receiver of the primary module when the at least one of the detectors is actuated.

13. The automatic fire extinguishing system according to claim 11, further comprising:

a container of fire extinguishing agent disposed within the primary module and another container of fire extinguishing agent disposed within the secondary module; and a propulsion system disposed within the primary module.

14. The automatic fire extinguishing system according to claim 11, wherein:

the secondary module connector of the primary module comprises a receptacle; and the primary module connector of the secondary module comprises a tubular protrusion.

15. The automatic fire extinguishing system according to claim 11, wherein the track comprises a first rail and a second rail, the first and second rails being vertically separated from one another.

* * * * *